US005555931A

United States Patent [19]

Lee et al.

[11] Patent Number: 5,555,931

[45] Date of Patent: Sep. 17, 1996

[54] HEAT EXCHANGER FOR SEPARABLE AIR CONDITIONER

[75] Inventors: Dong-Jin Lee; Jeom-Yul Yun, both of Seoul, Rep. of Korea

[73] Assignee: Goldstar Co., Ltd., Seoul, Rep. of Korea

[21] Appl. No.: 299,503

[22] Filed: Aug. 1, 1994

[30] Foreign Application Priority Data

Sep. 3, 1993 [KR] Rep. of Korea ..... 17667/1993
Sep. 3, 1993 [KR] Rep. of Korea ..... 17668/1993

[51] Int. Cl.[6] ..... F28F 9/26

[52] U.S. Cl. ..... 165/122; 165/145; 165/149

[58] Field of Search ..... 165/144, 145, 165/149, 150, 151, 122; 62/524, 526

[56] References Cited

U.S. PATENT DOCUMENTS

| | | | |
|---|---|---|---|
| 1,004,901 | 10/1911 | Poché | 165/145 |
| 1,759,011 | 5/1930 | Huet | 165/145 X |
| 1,782,205 | 11/1930 | Keenan, Jr. | 165/145 |
| 4,831,844 | 5/1989 | Kadle | 165/151 X |
| 4,995,453 | 2/1991 | Bartlett | 165/151 X |
| 5,076,353 | 12/1991 | Haussmann | 165/144 X |
| 5,388,426 | 2/1995 | Wada et al. | 165/122 X |
| 5,417,279 | 5/1995 | Wada | 165/122 |

FOREIGN PATENT DOCUMENTS

| | | | |
|---|---|---|---|
| 547450 | 6/1993 | European Pat. Off. | 165/122 |
| 63429 | 4/1984 | Japan | 165/122 |
| 161622 | 9/1984 | Japan | 165/122 |
| 110388 | 5/1991 | Japan | 165/122 |
| 347427 | 12/1992 | Japan | 165/145 |

*Primary Examiner*—Leonard R. Leo
*Attorney, Agent, or Firm*—Fliesler, Dubb, Meyer & Lovejoy LLP

[57] ABSTRACT

A small-sized heat exchanger for separable air conditioner not only saving the electric power but also reducing the cost. The heat exchanger has tube banks provided on a predetermined upper section of the air conditioner main body. A plurality of heat exchanging fins are placed under the tube banks and connected to a plurality of heat transfer tubes. Both the tube banks and the heat transfer tubes are supported by a pair of guide plates placed on opposed sides of both the tube banks and the heat transfer tubes. The tube banks include a plurality of small diameter tubes and a plurality of distribution manifolds. The manifolds are connected to bundles of small diameter tubes respectively.

1 Claim, 6 Drawing Sheets

HEAT EXCHANGER FOR SEPARABLE AIR CONDITIONER

BACKGROUND OF THE INVENTION

1. Field of the Invention

The present invention relates in general to heat exchangers for separable air conditioners and, more particularly, to a structural improvement in main bodies of such heat exchangers for miniaturizing the heat exchangers.

2. Description of the Prior Art

With reference to FIG. 1, there is shown a typical heat exchanger for a separable air conditioner. The typical heat exchanger includes an air conditioner main body designated by the numeral 1*a*. Mounted in back of the air conditioner main body 1*a* is a cross flow fan 2. Both the air conditioner main body 1*a* and the cross flow fan 2 are placed in the interior of a casing 1. The air conditioner main body 1*a* comprises a plurality of heat exchanging fins 3 of the thin plate type. A plurality of heat transfer tubes 4 penetrate and retain the heat exchanging fins 3. Generally, each heat exchanging fin 3 is made of aluminum while each heat transfer tube 4 is: constructed of copper tube having at least 7 mm diameter. In addition, the heat transfer tubes 4 generally have 9 or 10 stages and two rows, however, both the stages and the rows of the heat transfer tubes 4 may be changed in response to heat exchanging capacity of the heat exchanger. In the typical heat exchanger of FIG. 1, the number of stages of the heat transfer tubes 4 is 9 or 10, for example.

The operation of the above heat exchanger will be given hereinbelow in conjunction with FIGS. 2A and 2B.

The warm room air that was sucked into the air conditioner main body 1*a* through the front of the main body 1*a* exchanges the heat with the relatively low temperature of refrigerant flowing in the heat transfer tubes 4, thus to become cool air. The cool air in turn is discharged from the heat exchanger to the room through a grill (not shown) that is mounted on the lower section of the heat exchanger. In the heat exchanger, the refrigerant in the liquid phase is introduced into the heat transfer tubes 4 through the inlet 4*a* and exchanges the heat with the warm air. After the heat exchanging with the warm air, the liquid phase of the refrigerant is converted into the gas phase. The refrigerant in the gas phase in turn is discharged through the outlet 4*b* of the heat transfer tubes 4 so as to be introduced into a compressor (not shown). In cooling operation of the separable air conditioner, the above circulation cycle of the refrigerant is repeated.

The operation of the refrigerant flowing in the heat transfer tubes 4 of the typical heat exchanger of the separable air conditioner will be described in detail hereinbelow.

FIG. 3 is a view showing an evaporative flow of the refrigerant in a horizontal pipe section of the heat transfer tubes 4 in accordance with refrigerant flow direction.

The flow type of the refrigerant in the heat transfer tubes 4 of the heat exchanger, which heat transfer tubes 4 are mostly occupied by the horizontal tube sections, is changed in order of stratified flow annular flow→spray→annular flow→superheated vapor region. It has been generally noted that the heat exchanging effect of the refrigerant in the heat exchanger is best when the refrigerant shows either the annular flow type or the semi-annular flow type, which flow types cause the refrigerant to cover all over the interior walls of the heat transfer tubes 4. On the contrary, in the range of stratified flow or wavy flow, the refrigerant only fills the lower sections of the heat transfer tubes 4, so that the heat exchanging effect about the portion of stratified flow or wavy flow should be immaterial.

However, the range of both the stratified flow and the wavy flow occupies relatively large part of the stages of the heat transfer tubes 4, that is, 3 or 4 stages from the uppermost stage of the heat transfer tubes 4. In this regard, the desired miniaturization of the heat exchanger of the separable air conditioner may be achieved by reduction of the range of both the stratified flow and the wavy flow.

As described above, the typical heat exchanger for separable air conditioner is produced using the same heat transfer tubes along with the same heat exchanging fins so as to provide convenience in both designing and producing of the heat exchanger. The length of undesirable range or the range of both the stratified flow and the wavy flow should be increased, so that the heat exchanger should be large-sized.

Since the typical heat exchanger for separable air conditioner should have heat transfer tubes of 9 or 10 stages, the cost for production of heat exchanger should be increased, thus to cause the heat exchanger to be insufficiently competitive in price.

SUMMARY OF THE INVENTION

It is, therefore, an object of the present invention to provide a small-sized heat exchanger for separable air conditioner.

It is another object of the present invention to provide a heat exchanger for separable air conditioner which is small-sized, thus to not only save the electric power but also reduce the cost.

In accordance with a preferred embodiment of this invention, the heat exchanger for separable air conditioner comprises air conditioner main body having a plurality of heat exchanging fins and a plurality of heat transfer tubes; a cross flow fan mounted in back of the air conditioner main body; and a casing for incasing both the air conditioner main body and the cross flow fan, further comprises: tube banks provided on a predetermined upper section of the air conditioner main body;the heat exchanging fins placed under the tube banks; the heat transfer tubes connected to the heat exchanging fins; and guide plates placed on opposed sides of both the tube banks and the heat transfer tubes for supporting both the tube banks and the heat transfer tubes.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
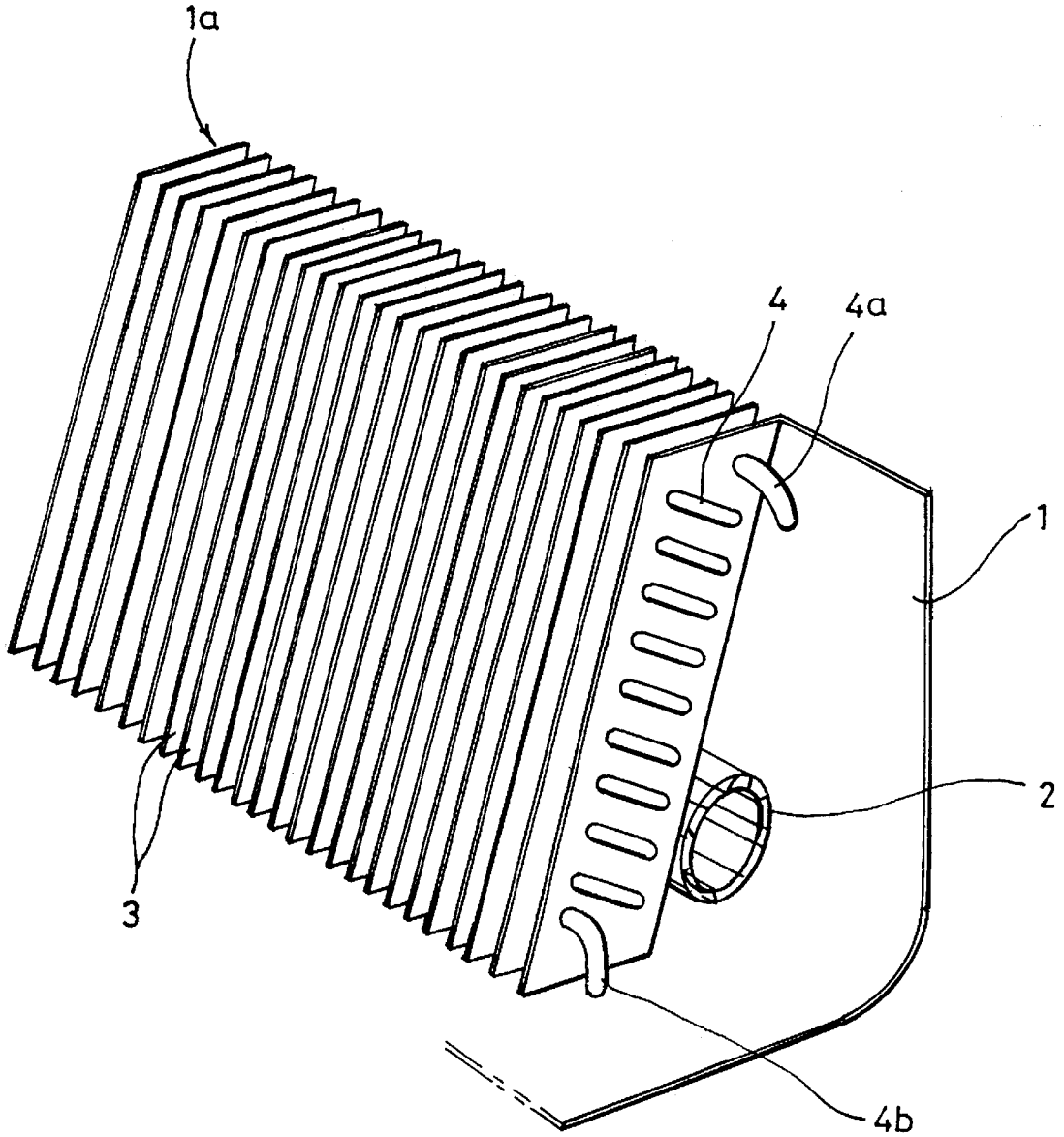
FIG. 1 CONVENTIONAL ART
FIG. 1 is a schematic perspective view of a typical heat exchanger for separable air conditioner.
Figure 2A:
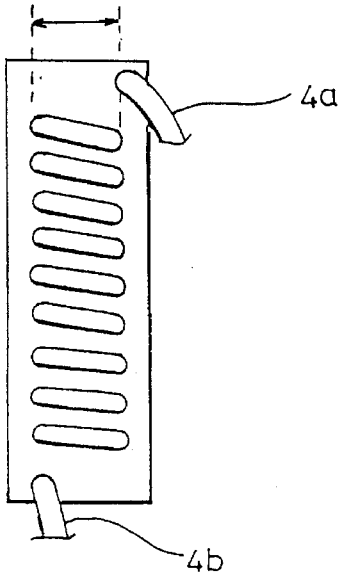
FIG. 2A CONVENTIONAL ART
FIGS. 2A and 2B are a side view and a front view of the heat exchanger of FIG. 1 respectively.
Figure 2B:
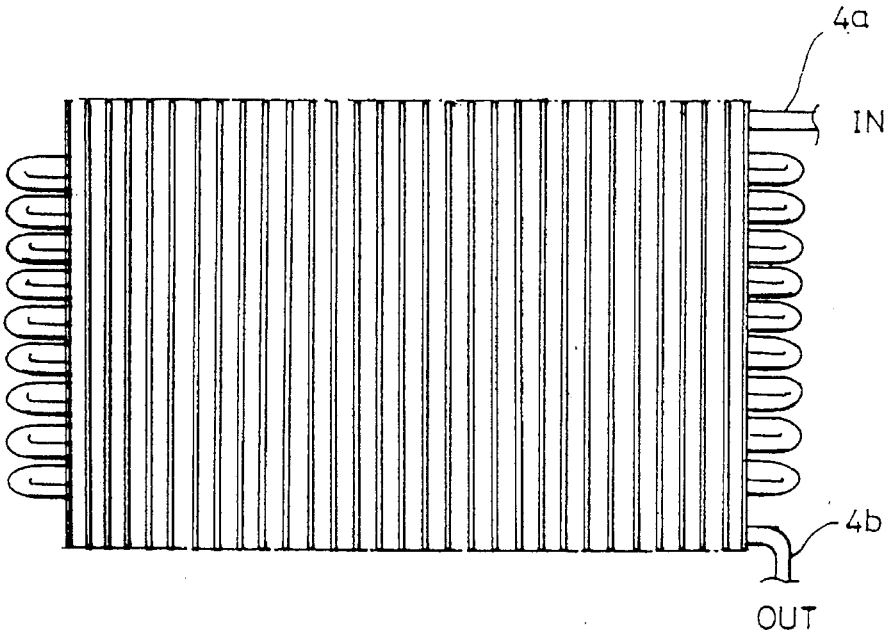
FIG. 2B CONVENTIONAL ART
Figure 3:
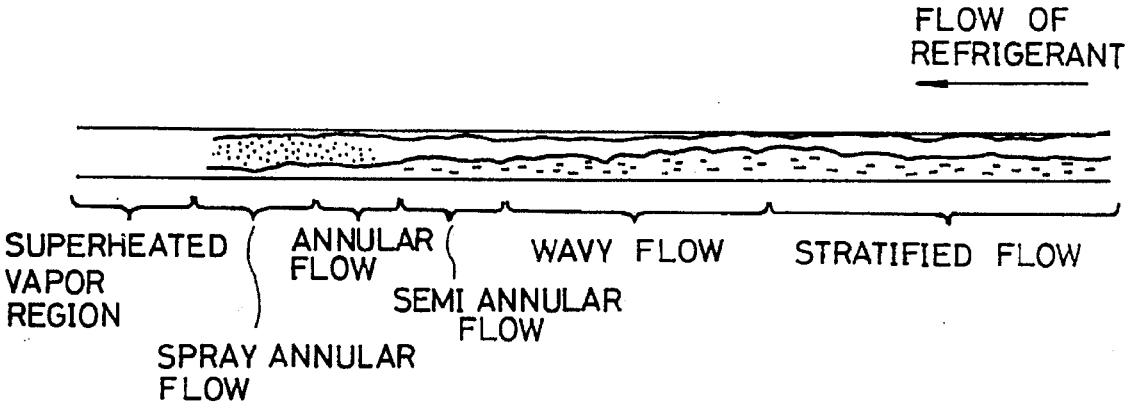
FIG. 3 is a view showing an evaporative flow of refrigerant in a horizontal section of a heat transfer tube in accordance to refrigerant flow direction.
Figure 4A:
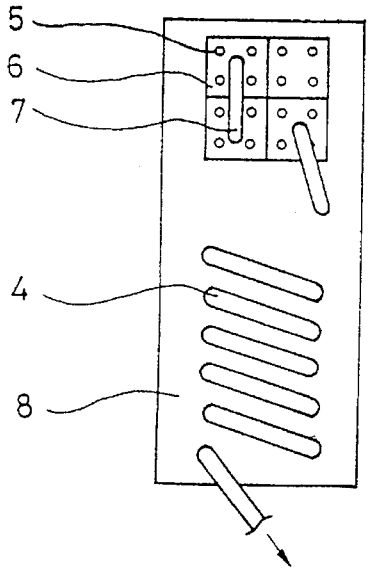
FIGS. 4A and 4B are a side view and a front view of a heat exchanger for separable air conditioner in accordance with a primary embodiment of the present invention respectively.
Figure 4B:
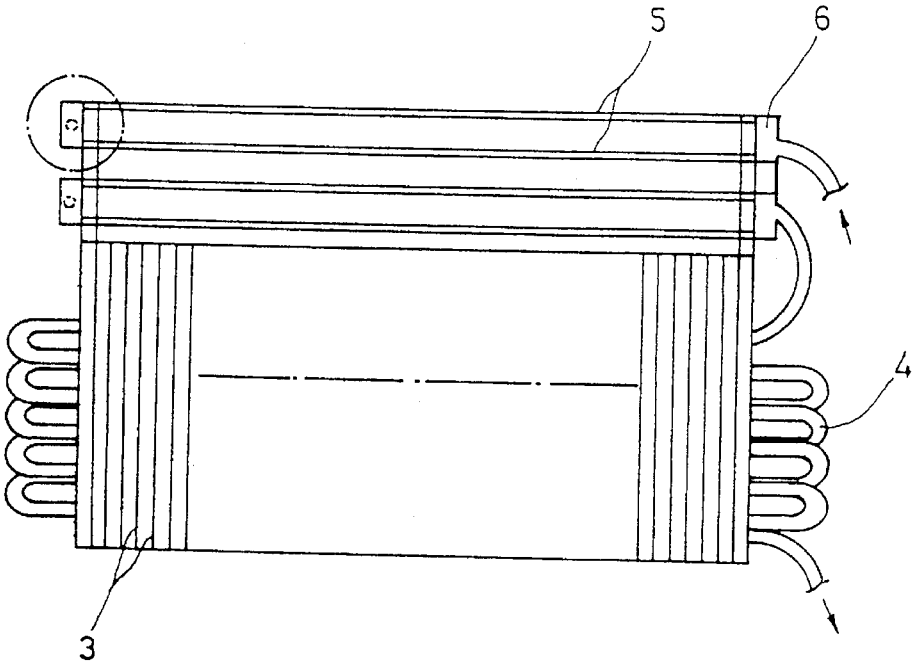

With reference to FIGS. 4A and 4B, there is shown in a side view and a front view a heat exchanger for separable air conditioner in accordance with a primary embodiment of the present invention. As shown in these drawings, the heat exchanger of this invention is provided with tube banks that are placed on predetermined upper section of the air conditioner main body 1*a* of FIG. 1. Vertically placed under the tube banks are a plurality of heat exchanging fins designated by the numeral 3. The plurality of heat exchanging fins 3 are fitted over a plurality of heat transfer tubes 4.

Figure 5:
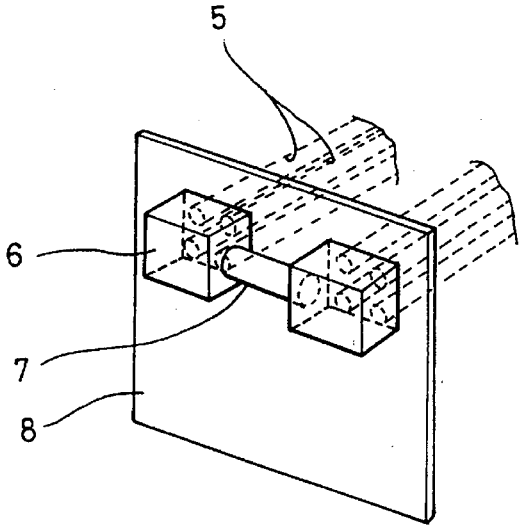
FIG. 5 is an enlarged perspective view of the section A of FIG. 4B.

As best seen in FIG. 5, the tube banks include a plurality of small diameter tubes 5. The tube banks further includes a plurality of distribution manifolds 6. Each of the manifolds 6 is connected to a predetermined number of small diameter tubes 5. The manifolds thus divide the plurality of small diameter tubes 5 into several bundles of predetermined number of tubes. The manifolds 6 in turn are connected to and communicate with each other through connection tubes 7.

In the present invention, it is preferred to use small diameter tubes having diameters ranged from 4 mm to 7 mm as the small diameter tubes 5. For example, the heat exchanger according to the primary embodiment uses the tubes having 4 mm diameter as the small diameter tubes 5. With the use of 4 mm diameter tubes as the small diameter tubes 5, the stratified flow of the refrigerant is readily changed into the effective annular flow. That is, when the refrigerant, which refrigerant shows the stratified flow type when flowing in the heat transfer tubes 4 generally having a diameter not smaller than 7 mm, is introduced into and flows in the 4 mm diameter tubes 5, the refrigerant sufficiently covers all the interior walls of the 4 mm diameter tubes 5. Therefore, the refrigerant readily changes its flow type from the stratified flow type into the desired annular flow type. Hence, differently from the prior heat exchanger, neither the heat transfer tubes 4 nor the heat exchanging fins 3 need the upper sections where the refrigerant flows, showing the stratified flow type. In the primary embodiment, the heat exchanger preferably includes four-manifolds 6, each collector 6 being connected to four small diameter tubes 5. The heat exchanger of the primary embodiment thus includes sixteen tubes 5.

Since each heat exchanging fin 3 has no upper section where the refrigerant flows in the stratified flow type, the size of each heat exchanging fin 3 may be remarkably reduced in comparison with the prior heat exchanging fins. The heat exchanger of this invention thus includes small fins 3 that are placed under the tube banks. The heat transfer tubes 4 penetrate the interior sections of the heat exchanging fins 3. The heat transfer tubes 4 are connected to each other at their ends through U tubes. Placed on opposed sides of both the tube banks and the heat transfer tubes 4 are a pair of guide plates 8 that are adapted for supporting both the tube banks and the heat transfer tubes 4 in place.

In the above heat exchanger according to the primary embodiment of this invention, the refrigerant is introduced into the tube banks through the manifolds 6 that are placed on the right side of the tube banks. When the refrigerant flows in the small diameter tubes 5 of the tube banks, the refrigerant rapidly changes its flow type from the stratified flow type into the annular flow type and, at the same time, starts heat exchanging with the warm air. After passing through the tube banks, the refrigerant passes through the heat transfer tubes 4. The heat exchanging effect of the refrigerant is more improved when the refrigerant passes through the heat transfer tubes 4, so that the heat exchanger of this invention shows the same cooling effect as that of the prior heat exchanger while reducing the load imposed on the heat exchanging fins 3. Therefore, the heat exchanging area of the heat exchanging fins 3 may be reduced by 30–40% and, at the same time, the number of stages of the heat transfer tubes 4 may be reduced from 9 or 10 stages to 5 or 6 stages. The total size of the heat exchanger may be thus reduced by 20–25%, thereby achieving the miniaturization of the heat exchanger for separable air conditioner. Since the heat exchanger of the primary embodiment reduces the pressure drop of the air, thus to reduce the wind flow of a motor fan to a predetermined level and to save the electric power and to reduce the cost of the material of the heat exchanger and to reduce the production cost of the heat exchanger.

Turning to 6A and 6B, there is shown in a side view and a front view a heat exchanger for separable air conditioner in accordance with a second embodiment of the present invention respectively. As shown in these drawings, the heat exchanger according to the second embodiment includes a plurality of heat exchanging fins 13 of the rectangular shape. Opposed side ends of each of the heat exchanging fins 13 are provided with a plurality of tube fixing slots 15*a*. The tube fixing slots 15*a*, which are spaced out at regular intervals, will receive therein and fix a plurality of small diameter tubes 15. In this second embodiment, the small diameter tubes 15, comprising a plurality of horizontal tubes and a plurality of curved tubes, constitute a predetermined section of refrigerant passage of the heat exchanger. If briefly described, the heat exchanger according to the second embodiment reduces the number of stages of heat transfer tubes 14 from 9 or 10 stages to 6 or 7 stages and includes the small diameter tubes 15 placed between the heat transfer tubes 14.

Figure 6A:
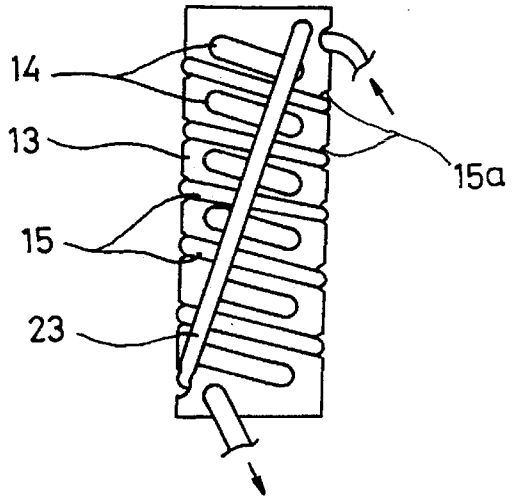
FIGS. 6A and 6B are a side view and a front view of a heat exchanger for separable air conditioner in accordance with a second embodiment of the present invention respectively.
Figure 6B:
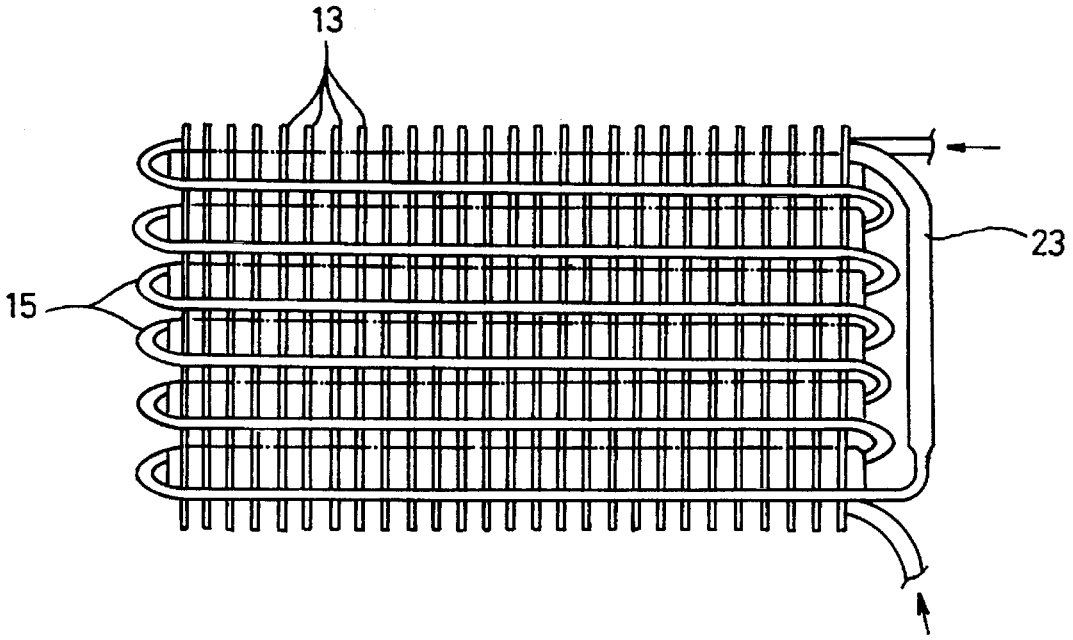
Figure 7:
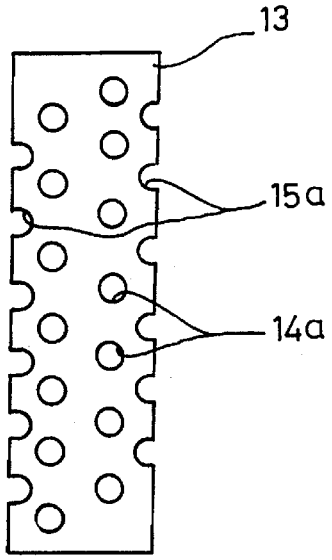
FIG. 7 is a view showing the outer appearance of a heat exchanging fin of the heat exchanger according to the second embodiment of the present invention.
Figure 8:
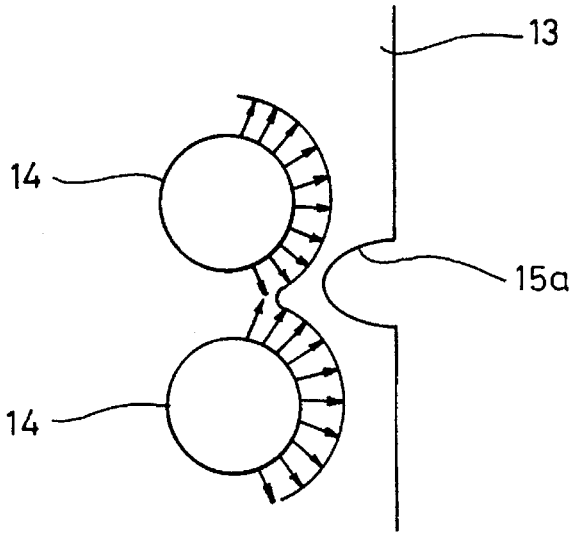
FIG. 8 is an enlarged view showing distribution of heat transfer rate between heat transfer tubes and a heat exchanging fin of the heat exchanger according to the second embodiment of the present invention.

As shown in FIGS. 6B and 7, the small diameter tubes 15 are received in and fixed by the tube fixing slots 15*a* that are formed on opposed side ends of the heat exchanging fins 13. The heat transfer tubes 14 and the small diameter tubes 15 are connected to each other through U tubes 23. When there is no tube fixing slot 15*a* on opposed side ends of each of the heat exchanging fins 13, the heat transfer effect between the heat transfer tubes 14 and the heat exchanging tubes 15 will be bad particularly at the portions about the tube fixing slots 15*a* as represented in FIG. 8.

In order to produce the heat exchanger of the second embodiment, the plurality of heat exchanging fins 13 are arranged in series prior to insertion of the heat transfer tubes 14 into a plurality of heat transfer tube insert holes 14*a* of the heat exchanging fins 13. Thereafter, the plurality of small diameter tubes 15 are inserted into the tube fixing slots 15*a* of the heat exchanging fins 13. When the small diameter tubes 15 are connected to the heat transfer tubes 14 using the U tubes 23, assembling of the heat exchanger is finished.

Here, the diameter of the small diameter tubes 15 is preferably ranged from 4 mm to 6.5 mm.

In the above heat exchanger according to the second embodiment of the present invention, the stratified flow range conventionally occupying 3 or 4 stages of the heat transfer tubes is preferably rapidly changed into the annular flow range by surrounding the exterior of the heat exchanging fins 13 using the small diameter tubes 15. Otherwise stated, the refrigerant, which intended to be gathered to the lower sections of the large diameter tubes, comes into contact with larger area of the tubes when the refrigerant flows in the small diameter tubes. Furthermore, the flow rate of the refrigerant is increased due to diameter reduction of the tubes, thereby promoting the change of the flow range from the stratified flow range into the annular flow range and improving the heat exchanging effect.

The possible pressure drop caused by reduction of the area occupied by the heat transfer tubes may be prevented by enlarging the angle of the U tubes surrounding the exterior of the heat exchanging tubes. When the flow type of the refrigerant is initially changed into the annular flow type at the last portion of the small diameter tubes, the heat transfer area is enlarged by the heat exchanging fins. In this regard, the heat exchanging effect is improved as the refrigerant is introduced into the heat exchanger, so that the heat exchanger of this invention achieves the same cooling capacity as that of the prior heat exchanger.

Therefore, the heat exchanger for separable air conditioner in accordance with the present invention reduces the stages of the heat transfer tubes from 9 or 10 stages to 6 or 7 stages, thus to become small-sized and to reduce the cost. With the small size of the heat exchanger of this invention, the pressure drop of the air is desirably reduced so as to reduce the wind flow of the motor fan and to save the electric power.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. In a heat exchanger for an air conditioner comprising an air conditioner main body having a plurality of heat exchanging fins and a plurality of heat transfer tubes, a cross flow fan mounted in back of the air conditioner main body, and a casing for incasing both the air conditioner main body and the cross flow fan, wherein the improvement comprises:

tube banks provided on a predetermined upper section of said air conditioner main body including:

a plurality of small diameter tubes;

a plurality of distribution manifolds, said manifolds being connected to bundles of small diameter tubes respectively, thus to divide the plurality of small diameter tubes into several bundles of predetermined numbers of said tubes; and a plurality of connection tubes connecting said distribution manifolds to each other, thus to cause said manifolds to communicate with each other;

said heat exchanging fins placed under said tube banks; said heat transfer tubes connected to said heat exchanging fins; and guide plates placed on opposed sides of both said tube bank and said heat transfer tubes for supporting both the tube banks and the heat transfer tubes.

* * * * *